United States Patent [19]

Sartorio

[11] 4,261,150

[45] Apr. 14, 1981

[54] PREFABRICATED CONSTRUCTION ELEMENTS PROVIDED WITH A REINFORCEMENT OPERATING AS A CAISSON, EQUIPMENT FOR PRODUCING SUCH ELEMENTS AND METHOD OF FABRICATION AND APPLICATION IN BUILDING ERECTION

[76] Inventor: Sergio Sartorio, Via Medeghino, 7, 20141 Milan, Italy

[21] Appl. No.: 872,004

[22] Filed: Jan. 24, 1978

[30] Foreign Application Priority Data

| | | | |
|---|---|---|---|
| Jan. 28, 1977 | [IT] | Italy | 19741 A/77 |
| May 5, 1977 | [IT] | Italy | 23223 A/77 |
| Jul. 7, 1977 | [IT] | Italy | 23325 A/77 |

[51] Int. Cl.[3] ..... E04C 2/06; E04C 2/26

[52] U.S. Cl. ..... 52/405; 52/565; 52/612; 52/431

[58] Field of Search ..... 52/612, 430, 431, 432, 52/425, 561, 562–568, 426–431, 380–383, 674, 735, 235, 270, 405

[56] References Cited

U.S. PATENT DOCUMENTS

| | | | |
|---|---|---|---|
| 1,102,991 | 7/1914 | McKennee | 52/428 |
| 1,421,278 | 6/1922 | Matthews | 52/429 |
| 2,064,910 | 12/1936 | Harper | 52/235 |
| 2,088,645 | 8/1937 | Fling | 52/565 |
| 2,250,763 | 7/1941 | Hild | 52/426 |
| 2,457,982 | 1/1949 | Deichmann | 52/270 |
| 2,573,482 | 10/1951 | Peik | 52/413 |
| 3,943,676 | 3/1976 | Ickes | 52/309.11 |

FOREIGN PATENT DOCUMENTS

| | | | |
|---|---|---|---|
| 128143 | 3/1948 | Australia | 52/562 |
| 481597 | 3/1952 | Canada | 52/612 |
| 900329 | 9/1944 | France | 52/674 |
| 906470 | 5/1945 | France | 52/380 |
| 461751 | 10/1968 | Switzerland | 52/431 |
| 4971 | of 1906 | United Kingdom | 52/565 |

*Primary Examiner*—James L. Ridgill, Jr.

*Attorney, Agent, or Firm*—Michael J. Striker

[57] ABSTRACT

Composite building elements of reinforced concrete having trimmed outer surfaces, formed through the coupling of two flat basic semielements, each of which comprising a continuous metal reinforcement according to a fret-like pattern, formed of a perforated metal laminate, or a latticework or a bent wire net said basic semielements comprising on the outer trimming side also a flat wire net embedded within an initial layer of cement mixture, the fineness of which decreases from the outer surface to said inner reinforcement, so that the complete element provided through the coupling of the two semielements has the two exposed sides perfectly smooth and trimmed; the fabrication and coupling of said semielements being realized by an automatic equipment working in a continuous cycle, comprising at least one feeding continuous rubber belt running over a plane of transverse metal box elements articulated to one another and sidewise guided by C-shaped elements opposite to one another, along the sides of said continuous belt two parallel flexible rings being provided stretched between at least two supporting rollers moving along with the continuous belt, shaping the sides of the basic semielement, said flexible rings being urged by lateral pressing rollers; the forming bed for the basic semielements being covered with a sheet of plastic material moving along with the belt as supplied by an upstream mounted roll in order to prevent the working plane or table to be soiled; said equipment being automated by two parallel tracks A and A', at least one upper carriage provided with two pneumatic jaws grasping the semielement after setting thereof to carry it from one to the other track; an automous self contained carriage running laterally of or on said track A' to grasp and upstream carry said upper carriage together with the semielement, and finally a turn over conveyor means downstream carrying said upper carriage with said semielement and moves it from plane C to plane D after having turned it over.

6 Claims, 26 Drawing Figures

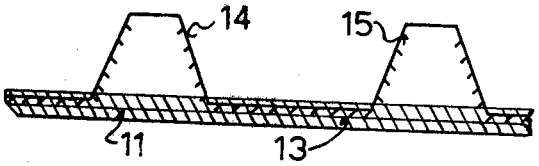
FIG.1
FIG.2
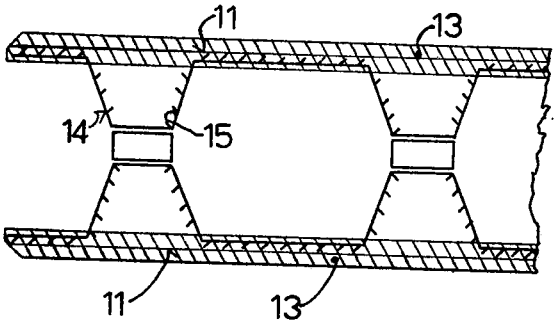
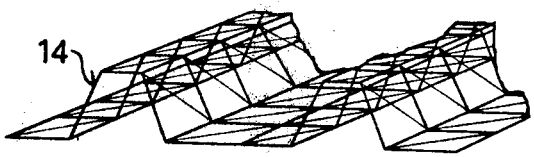
FIG.3
FIG.4
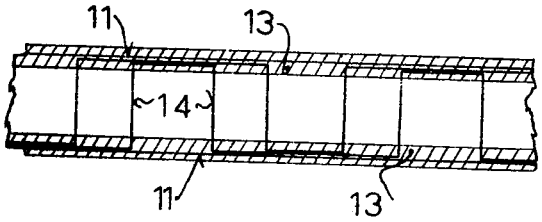

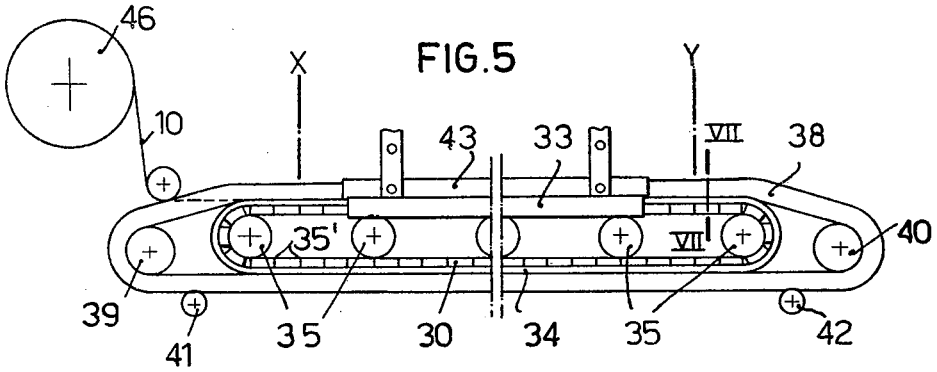
FIG.5
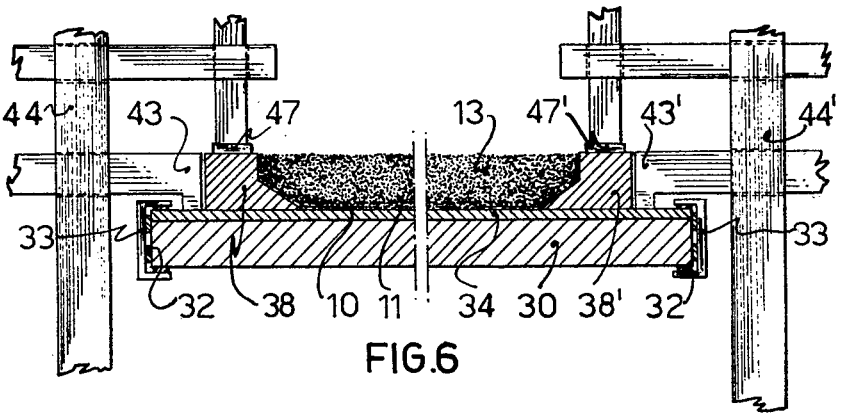
FIG.6
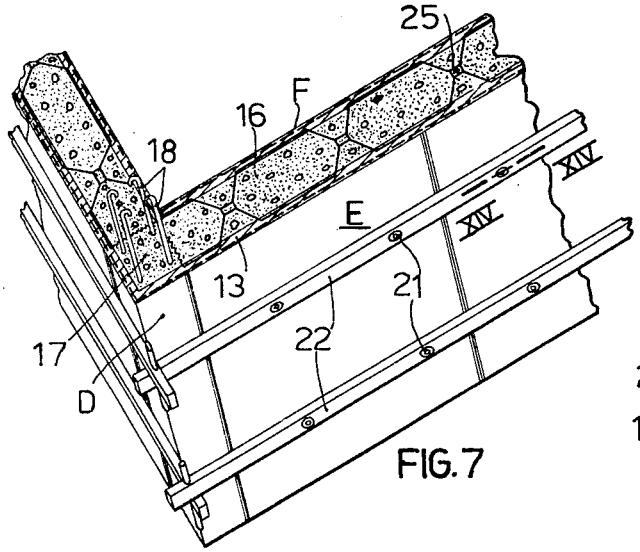
FIG.7
FIG.8
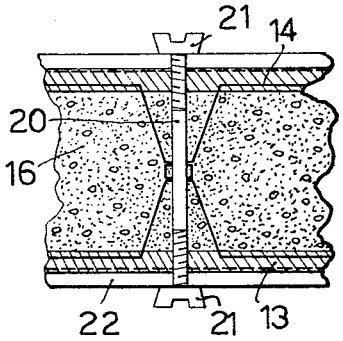

PREFABRICATED CONSTRUCTION ELEMENTS PROVIDED WITH A REINFORCEMENT OPERATING AS A CAISSON, EQUIPMENT FOR PRODUCING SUCH ELEMENTS AND METHOD OF FABRICATION AND APPLICATION IN BUILDING ERECTION

This invention proposes a new system in the building field for industrialization of preferably apartment houses or buildings, bringing about novelties most rationally solving the problem of full programming, and is directed to provide a substantial industrial advance, availing the market with a product of high technical and qualitative level, along with saving and further important advantages.

A prefabricated element according to the invention, which may be in the form of a panel of any desired size, or a beam, or a partial or total slab, comprises two closely fitted reinforced concrete semielements, having the outer sides thereof previously smoothed out and plastered. The method of fabrication is carried out on a machine having a working plane or surface covered with a continuous sheet of plastic material, on which a layer of fine cement mixture is spread, a metal reinforcing net or lath on the latter, and finally a further layer of cement binding mixture, subjected to vibration for fitting the flat surface to receive the actual carrying reinforcement, comprising a laminate or a metal cage or lattice-work according to a fret-shape pattern, having flat bearing zones both at the top and bottom layers. Where a metal laminate is used as a reinforcement, its surface will have to be perforated or slotted with blades blanked out from the surface and projected for the passage of concrete from one to the other side, so as to form a reinforced structure, which following concrete setting makes up the caisson, panel or beam or slab or platband to be used as basic element in the building to be erected.

This basic element can be used horizontally alone, or doubled with two vertically spaced apart semielements to provide intermediate air chambers. For an increased thickness in the air chamber, spacers can be inserted between two opposite projections of two inwardly facing fret-shaped reinforcement. When drawn near one another, these basic caisson operating elements, provided or not with spacing shims, may be bound to one another by bolts, tie rods or the like, and provide prearranged spaces or openings for hydraulic, electrical or telephonic services, which are accessible for maintenance.

The invention also comprises a mechanical equipment for production of the reinforced semielements intended to form a disposal type of caissons. In order to provide a complete basic element, two thoroughly parallel and spaced apart basic elements should be drawn near, so as to leave an inner space or opening for the concrete casting, in which the reinforcements are incorporated.

The thicknesses of the semielements, and accordingly of the air chamber or inner space may be determined as required, and the sizes in height, width and length of each individual semielement can be also varied by using annular adjustable side containing guides.

The invention has also studied and solved the problem of joints between adjoining panels, the formation of inner insulating spaces adjacent one or both the panel sides, the connection between vertical walls and horizontal slabs, the insertion of a complete prefabricated unit, such as window, a door or other building fixture, between adjoining panels making up a facade, the provision of insulated continuous inner channels, inspectable by means of openings or doors arranged at predetermined locations, for the fittings of common services. A simple equipment has been provided for preparing the basic semielements to be connected for wall forming, as well as an automatic equipment for producing basic semielements, and coupling thereof with a continuous industrial process.

The accompanying drawings diagrammatically and not restrictively shown the process of producing the basic semielements and show the constituent structure thereof, and further show the equipment for forming the semielements which by coupling constitute continuous carrying walls, or insulating or soundproof walls.

Particularly, in the drawings:

FIG. 1 is a cross-sectional view showing a basic semielement prefabricated according to the invention, when the reinforcement comprises a fret-bent sheet or plate, provided with slots for the concrete passage;

FIG. 2 is also a cross-sectional view of a prefabricated manufacture more complicated than the former, comprising two coupled basic semielements (as in FIG. 1), by matching the flat surfaces of two opposite reinforcements, also made of perforated sheet with fret-like undulations;

FIG. 3 is a perspective view showing a portion of reinforcement comprising a latticework of electrowelded rods or bent over net, having the same profile as FIGS. 1 and 2, with fret-like undulations;

FIG. 4 is a longitudinal sectional view showing a complete panel, wherein the fret-like undulations are right angled, the reinforcement being made of perforated sheet as in FIGS. 1 and 2, or wire net bent according to a rectangular fret pattern;

FIG. 5 is a schematic side view of the machine or equipment, on which the panel is prepared;

FIG. 6 is a cross-sectional view taken along line VI—VI of FIG. 5;

FIG. 7 is a perspective view of an angle construction carried out with panels operating as caissons of the composite type of FIG. 2;

FIG. 8 is an enlarged view showing a cross connection location of two coupled basic semielements, connected by means of disposable connecting bolt and concrete casting;

Figure 11:
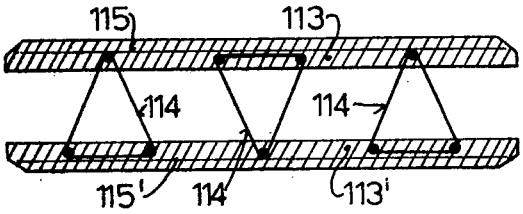
Figure 15:
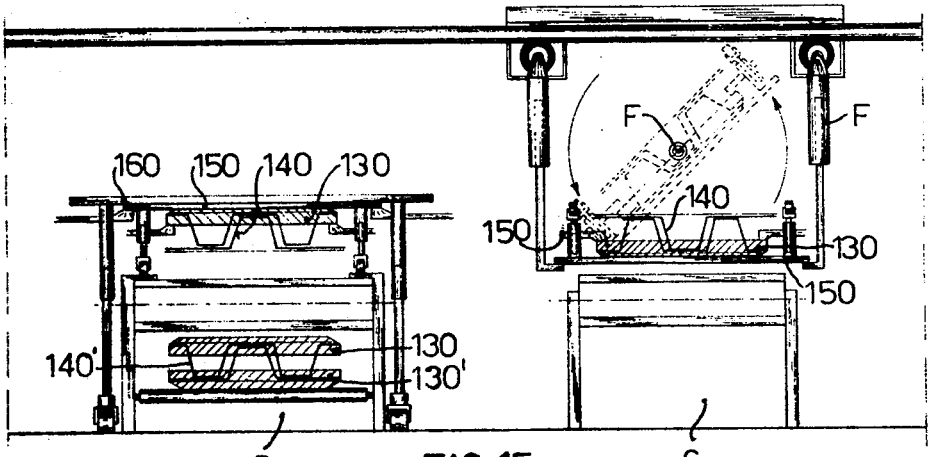
Figure 12:
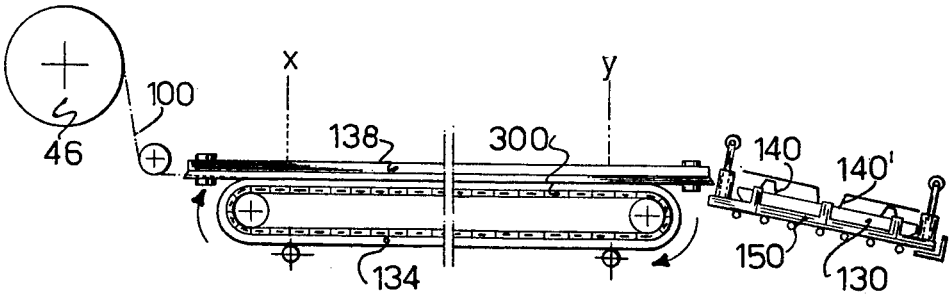
Figure 13:
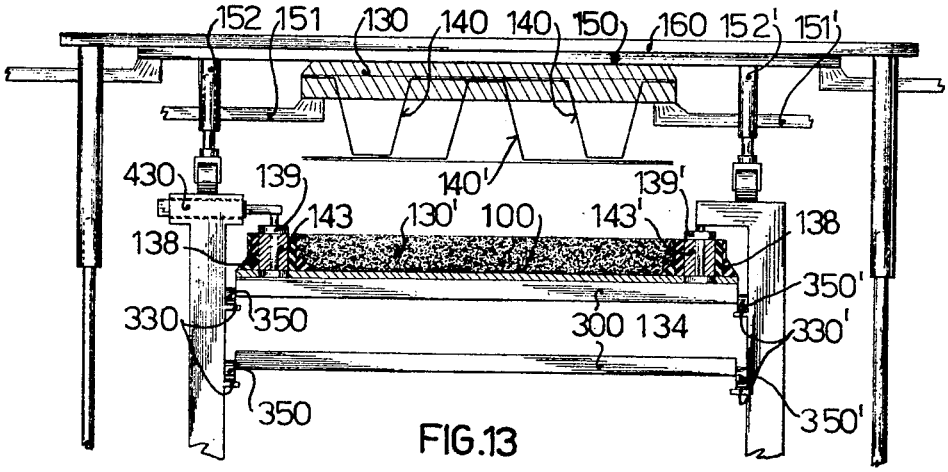
Figure 14:
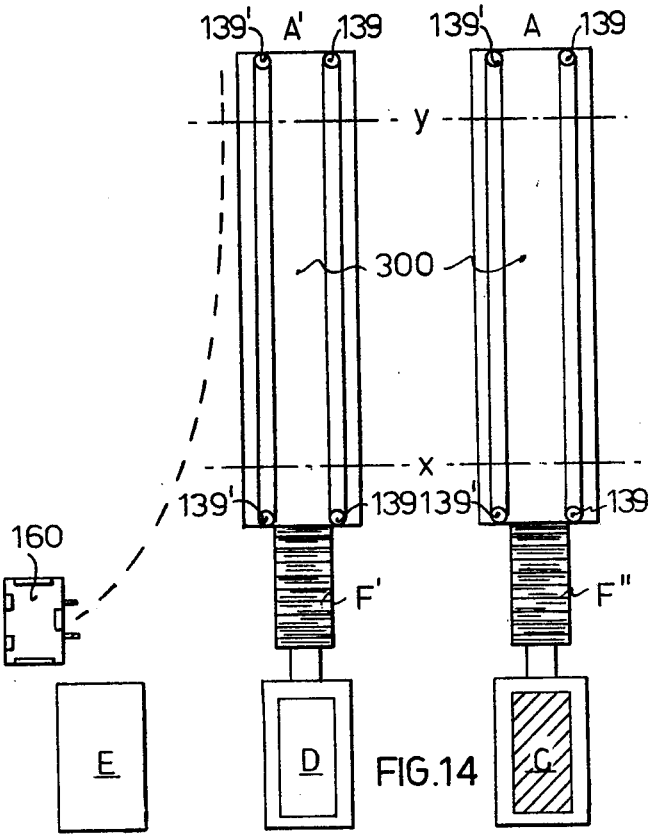
Figure 16:
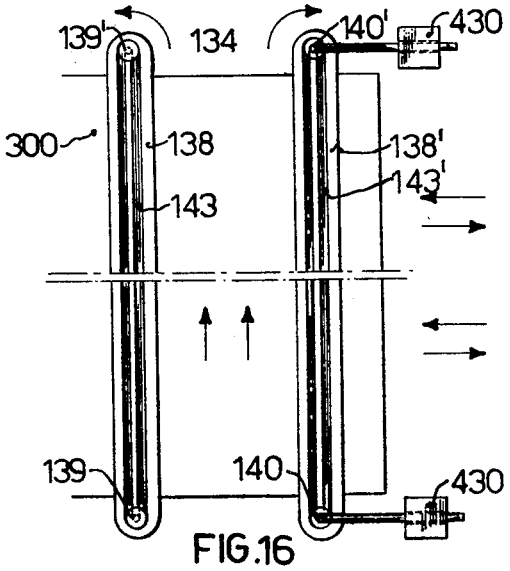

FIG. 11 shows an approach, wherein the panel comprises two basic semielements 113, 113' interconnected by an intermediate reinforcement 114 comprising a triangle latticework, the apices of which are anchored in said layers 113, 113' and bound with the completely buried reinforcement nets or laths 115, 115';

FIG. 12 is a side longitudinal view showing an example in a schematic diagram of automated equipment for the fabrication of semielements which are then coupled by turnover of a hardened semielement, brought to bear on the still fresh underlying semielement;

FIG. 13 is a cross-sectional view showing the same equipment of FIG. 12, but on enlarged scale for a clearer representation of the details;

FIG. 14 is a top plan view on reduced scale showing the automatic equipment of FIGS. 12 and 13;

FIG. 15 is cross-sectional view showing the two tracks of FIG. 14 at the zone where the hardened semipanel is turned over the still fresh semipanel;

FIG. 16 is a top view showing the working path or track, wherein the arrows indicate the rotary direction for the annular members 138, 138' on tension rollers 139, 139', 140, 140', and the running direction for the conveying sheath 134.

Figure 17:
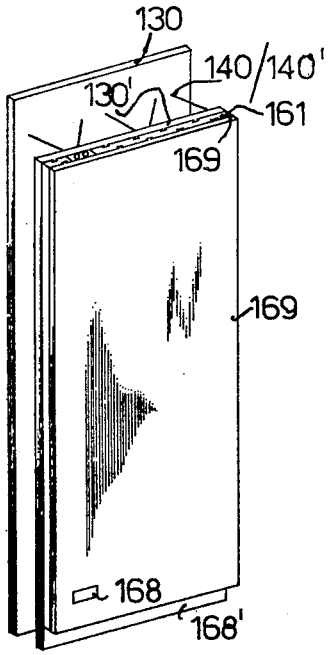
Figure 18:
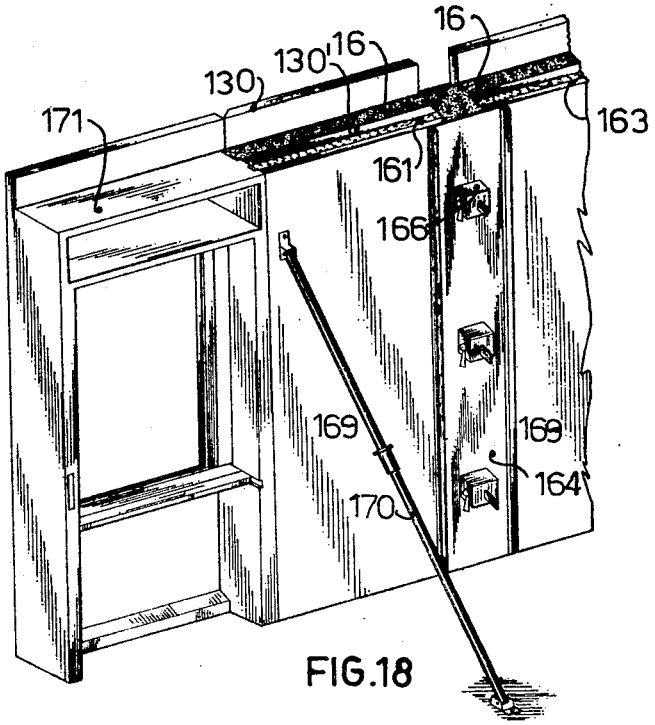
Figure 19:
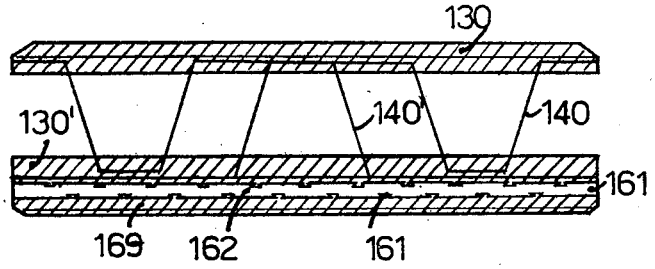
Figure 20:
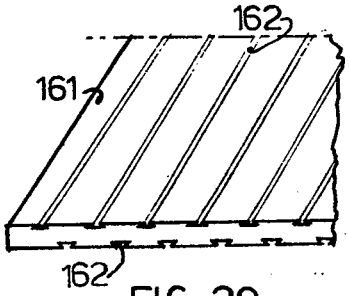
Figure 21:
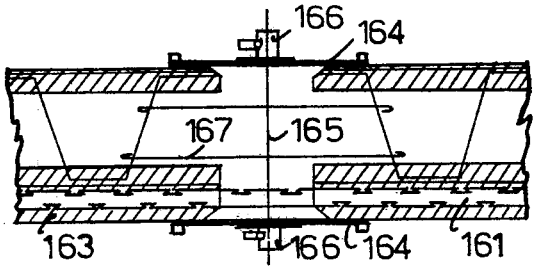
Figure 22:
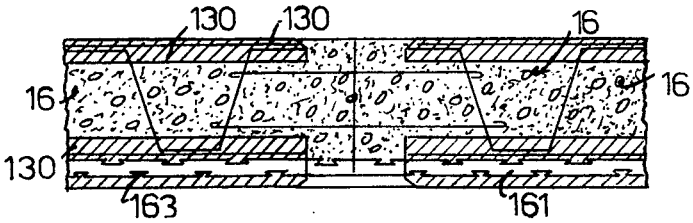
Figure 23:
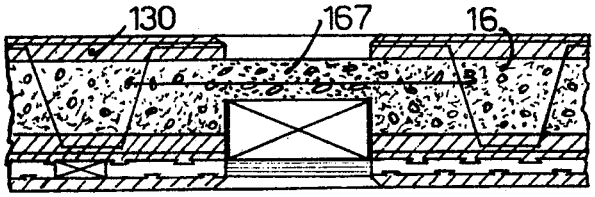
Figure 24:
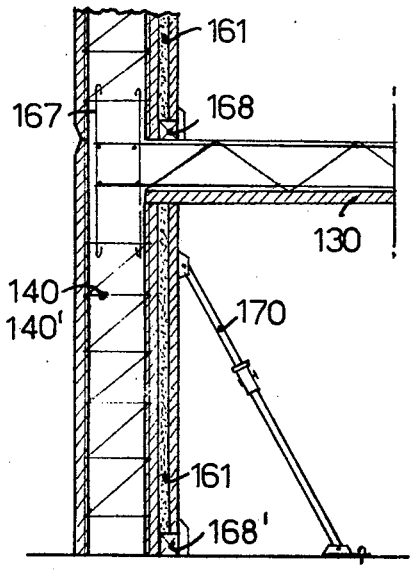
Figure 25:
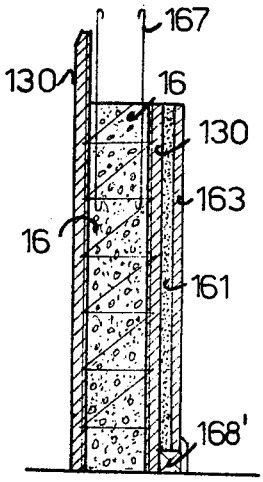
Figure 26:
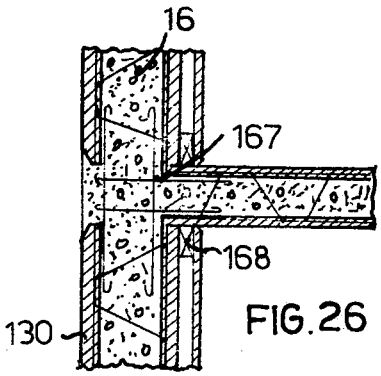

FIG. 17 is also a perspective view showing a panel comprising two semielements coupled with still free reinforcements in the space for receiving the concrete casting;

FIG. 18 is also a perspective view showing two hollow panels as filled up with concrete, to which a prefabricated window monoblock for facade has been drawn near;

FIG. 19 shows two semipanels of the type shown in FIG. 1, which are facing each other to form the hollow panel, one of the two semipanels including and additional insulating layer of plates or granulates;

FIG. 20 is a perspective view showing this insulating layer to be inserted in the semipanel shown in FIG. 19;

FIG. 21 is a sectional view showing two end portions of two panels as in FIG. 17, but connected by two external plate joint coverings 164, and blocked by means of clamps 166;

FIG. 22 is a view showing the same joint of FIG. 21 after filling up with concrete and after removal of said two clamps 166;

FIG. 23 is a view showing the formation of a vertical channel 167 between two adjoining panels for containing a technological plant or system, which is inspectable at various heights;

FIG. 24 is a vertical sectional view of a front wall not yet filled up with concrete and connected with a horizontal slab element;

FIG. 25 is a vertical sectional view of a front wall as that of FIG. 24, wherein the vertical cavity has been filled up with concrete 16; and FIG. 26 is a horizontal sectional view showing an outer perimetral wall with an inner partition wall, with continuous inner castings 16 for connection and positioning of technological plant or system 168.

As shown in FIGS. 1 through 6 of the accompanying drawings, a semielement forming part of the panel, or slab or platband as prefabricated (with any desired size) for the erection of a structure according to the invention, is produced by initially depositing on a movable belt plane provided with continuous cycle feeding a membrane or sheet of plastic material 10, such as polythene, from a supply roll 46. This sheet 10 has spread thereon a fine cement mixture 11, which will become the exposed surface of the finished piece. Then, a preferably wire net or lath 12 is brought to bear on layer 11, and on the latter a cement binding mixture 13 subjected to vibration to ensure perfect adhesion to the meshes of said net or lath 12 and complete covering thereof on both sides. A preformed reinforcement 14 of slotted sheet (FIGS. 1 and 2) or metal latticework (FIG. 3) is laid out on this casting 10, 11, 12 and 13.

The reinforced concrete structure which is to be formed includes a reinforcement comprising, in the example shown in FIGS. 1 and 2, an iron sheet 14 having polygonal slots with tabs 15 passing therethrough, whereas the reinforcement in FIG. 3 is a cage of iron rods. In either case, the premixed concrete passes through the free spaces, so that after setting said concrete 16 embeds reinforcement 14, whereby the latter is firmly fixed.

The apparatus and method will now be described for continuous cycle factory fabrication of semielements used as disposable caissons in forming any walls and floors, preferably for apartment houses or buildings, with perfectly trimmed exposed sides.

Continuous cycle fabrication on rotary belt may be carried out in steam tunnel or on preheated plane.

As shown in FIGS. 5, 6, 15 and 16, a continuous belt processing rotating plane is used, as comprising flat box-type elements 30, articulated at 31 and made of stainless or galvanized metal, slightly spaced apart from one another, but bound with hinges and chains 35' for rolling up, slidable in two C-shaped guides 33, the latter being fixed for the longitudinal length or section indicated by X–Y in FIGS. 5 and 14.

A further continuous rotating plane with smooth belt surface is also provided and comprises a heavy sheath 34 of reinforced rubber or similar flexible plastic material, which is positioned on said plane 30 of closely adhering articulated boxes. These two elements 30 and 34 (FIG. 5), as closely adhering with rotary motion on bearings 35, driving by means of electric motor and belt or chain drives, travel on two metal C-shaped guides 33, to provide on said longitudinal length or section X–Y a resistant, movable and quite stretched working plane.

This plane has placed thereon two rings 38, 38' of rubbery resistant material, or of flexible plastic material, that are quite taut and closely adhering to elements 30–34. The tension of rings 38, 38' will be controlled by end rollers 39, 40 and 41, 42 (FIG. 5) carried on frames that can be adjusted by fasteners and return springs.

These rings 38, 38' may be of various cross-sections of angle type, as shown in the example of FIG. 13, and serve the purpose of acting as adjustable casting accomodating edges and as matrices for forming any type of chamfer or shape for side trimming of a panel according to the invention.

During forward movement or feeding of straight length or section X–Y, these rings 38, 38' are accomodated within adjustable guides 43, 43' (FIG. 6) for positioning of the rotating belt. After provision of the working plane, by means of pumps a first very fine layer 11 of cement mixture of limited thickness is spread thereon in its length X–Y (FIGS. 1 and 2) and immediately subjected to vibration. Whereupon, the wire net or lath 12 (FIGS. 1, 2 and 6) is placed, and then a coarser cement mixture 13 to maximum level or dimension of annular elements 38, 38'. Now the metal reinforcement 14 of perforated sheet or preformed rod cage (FIGS. 1 through 3) is laid, which reinforcement, as provided with plastic stakes or spacers, will penetrate into the vibrating concrete to the desired depth.

Flat lists will be prerannged for panel dimensioning in the direction of length or section X–Y, the lists then inserting in notches in said profiles or rings 38, 38'.

The castings, as prepared according to the invention and upon setting comprising reinforcements 14 in the thickness thereof, allow to provide panels suitable to form caissons of any size and thickness through said adjustable flexible profiles or rings 38, 38'.

Depending on use, the continuous belt may be of different lengths and widths, within the desired times of material laying and curing or seasoning, and may contain a plurality of profiles 38, 38' of a different shape, to produce in a continuous cycle and within a well defined period of time various sets of panels of different sizes.

At the outlet of curing or seasoning track, profiles 38, 38' would tend by rotating on a conical cylinder 40 to widen out, as required, for dismantling from the fabricated semielement, and completely cleaned owing to said plastic material sheet 10, are guided by roller rules or lists to resume parallel position and forward move to rollers 41 and 39 for re-use. At the track outlet, the cured panels ride on suitable planes of adjustable slope and are discharged on pallets, then classified and packaged.

FIG. 7 is a perspective view showing an angle structure, wherein pillar D-17 is formed by the same system as for the slab or panels, by using as in FIGS. 1 through 4 perimetral semielements of concrete, internally reinforced with perforated sheet or plate or rod cage as in 14, forming disposable caisson with the addition of conventional vertical reinforcements 18 and in case horizontal reinforcements for structure support. Then, disposable perforated through bolts 20 are provided for transverse connection, as applied by nuts 21 to be mechanically screwed down on end threads on stem 20, these bolts mainly serving for interconnecting the walls forming the structure caisson. Where the caissons comprise two basic semielements, as in FIG. 1, and drawn near each other as shown in FIG. 2, with the aid of external rods 22 which are removed and recovered along with nuts 21 after final setting of concrete, said perforated bolts 20 would instead remain disposably in position. For the formation of the various vertical elements (walls) and horizontal elements (floors), use will be made of premixed concretes to be continuously injected into the caissons provided with coupled panels of different widths, according to design.

It is provided to form vertical and horizontal channels to be left empty and accessible for the laying of hydraulic, electrical tubings or for other services, which may be anchored to the inner wall, with a gap or clearance to the builder's choice, or according to the designer's purposes.

The equipment of FIGS. 12 through 15 is an improvement over that of FIGS. 5 and 6, which expedites and makes more mechanized the production of the finished product. This novel automatic machine comprises two rotating tracks A and A', as that of FIGS. 5 and 6. Track A is for the production of semipanels 130 comprising its own reinforcements 140 and reinforcements which would belong to the other semipanel 130' into the still fresh layer of which said reinforcement 140 and 140' will penetrate following overturning of semipanel 130, duly cured and lowered on the working plane of track A'. Downstream of track A a roller plane F'' is provided and carries said semipanel 130 with its reinforcement 140 at a high speed on dwelling plane C, where carriage 150 has been previously positioned, as shown in FIG. 12. This carriage 150 will clasp semipanel 130, 140, 140' through pneumatic clamps 152, 152'. Assembly 130, 140, 150 is moved and turned over on dwelling plane D of second track A' by means of an automated turn over conveyor F (FIG. 15). After turn over, said mechanism F will release and move back to position on dwelling plane C. Then, self-contained carriage 160 is operated and clasps said carriage 150, 130, 140 and 140' by means of its associated pneumatic automatic clamps. From downstream to upstream this carriage quickly travels track A' and releases carriage 150 over the guides. Carriage 160 performs the task of causing reinforcements 140 and 140' to penetrate as required into still soft mixture 130' of semielement 130 for providing the final panel with the desired thickness.

On effecting this last operation, said self-contained carriage 160 has the further task to clasp, midway said length or section X–Y of track A', one of carriages 150 that have accomplished the task thereof of retaining layer 130 with reinforcements 140, 140' until setting of layer 130' with reinforcements 140, 140'. At midway of length or section X–Y for track A', carriages 150 are automatically released from layer 130 and clasped by self-contained carriage 160, quickly carrying them to dwelling plane D. Now, said turn over conveyor means F clasps one of said carriages 150 and moves it at turned over attitude with upwards wheels, as shown in FIG. 12, back to dwelling plane C. Then, this plane C is ready to receive from track A the cured semielement 130, 140, 140' which will be placed within carriage 150, as shown in FIG. 12.

The operation is now repeated and turn over means F repeats the preceding cycle.

The composite complete elements, as formed at midway of length or section X–Y of track A', proceed for curing to downstream of track A', automatically dismantled from rotating plane 300 and annular elements 138, 138', proceeding at a higher speed on roller means F' under dwelling plane D, and continuing on further gummed roller planes are moved completely finished to the stocking area.

The operation of self-contained carriage 160 is highly significant, since although being used and operating above track A' (FIG. 15), it can ride laterally of said track. In this case, the self-contained carriage is provided with two side arms 161 (FIG. 14) and uses dwelling plane E, instead of D. In this case also turn over conveyor means F would operate on plane E, instead of plane D.

Self-contained carriage 160 travels on driving wheels and may run on a line or track or on the floor, and is provided with automatic control devices and fitted with pneumatic clamping means and self-contained compressor.

Figure 9:
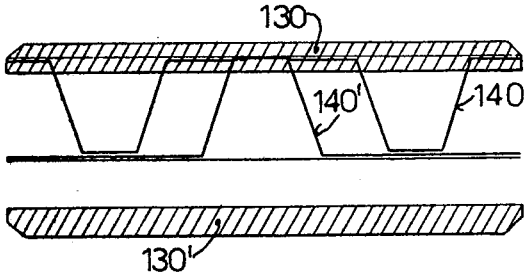
FIG. 9 shows the upper layer of a cured or settled element having two complete reinforcements 140—140', ready for coupling with the still soft lower layer 130'.
Figure 10:
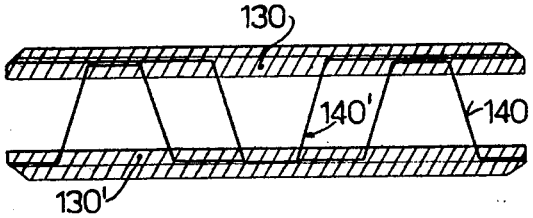
FIG. 10 shows the element of FIG. 9 as finished with the projecting portions of reinforcements 140—140' partly immersed in the underlying layer 130' to form a composite element.

FIGS. 9 and 10 show the two coupling steps as carried out in factory for two semipanels 130, 130', of which the first cured semipanel carries reinforcements 140 and 140' as penetrated into the hardened cement mixture, whereas the other semipanel is still soft and fresh, ready to receive the reinforcements carried by the other semielement. In FIG. 9 the two semielements are still spaced apart, while in FIG. 10 they have been coupled and are ready to receive on the building yard the concrete filling.

FIG. 11 shows an example of a different wire reinforcement having triangular elements 114 connected at the apices with nets or laths 115, 115' embedded within respective semielements 113, 113'.

With the top arrows, FIG. 16 shows the direction of rotation for the annular elements 138, 138' subtended on tensioning rollers 139, 139', and 140, 140' and lying on a horizontal plane, while central arrows indicate the movement of the conveying sheath 134. At 430 the regulators are designated for registering or adjusting said annular elements 138, 138'.

Plane 300 of belt track may be elongated or widened by varying the distance or spacing between the two annular elements according to production requirement.

FIG. 13 is a vertical cross-sectional view showing the working plane 300 and thereon a carriage 150 holding by pneumatically operated jaws 151 the upper cured layer 130 with reinforcement 140 to be coupled to the underlying fresh layer 130'. At suitable time, said carriage 150 is moved back upstream of length or section X–Y and lays at the desired height reinforcement 140 projecting from layer 130 on freshly cast layer 130', providing for penetration of reinforcement into the concrete.

The process for a building erection by means of basic building yard coupled elements or composite factory prepared elements according to the foregoing description, comprises the following operations:

formation of continuous foundation works using composite basic elements provided as described, either building yard prefabricated or building yard coupled with a carrying task (of the type shown in FIGS. 1, 2, 4, 7 and 8);

formation of horizontal works (platbands, slabs and floors) by using individual carrying elements (FIG. 25); and positioning of more complicated coupled elements with insulating layer 161 (FIGS. 19, 21, 22 and 24); and/or forming air chamber for the introduction of carrying castings and fitted with insulating materials.

FIG. 18 is a view showing an example for mounting a monoblock 171 for a window or door, rigid and provided with fittings, inserted between adjoining composite elements 169 including air chambers that are filled up on the building yard with programmed castings. This enables a fast mounting of the programmed frames or window sash frames only. By using contour frames, the same system enables to form outer and inner door openings.

On the building yard provision is made for mounting and bracing all the series of hollow panels shown in FIGS. 25 through 28 and fitted with supports provided for the formation of adjoining walls. Then, by means of pumps the continuous carrying or carrying-insulating castings 16 are laid between the two parallel vertical rigid surfaces 130 (FIG. 26) forming the air chamber therebetween. After complete filling up (FIG. 26) of the space between said elements 130, horizontal castings (FIG. 24) are then laid as lightened with caissons placed between the reinforcements.

This method allows to provide structures having the following substantial advantages;

Limited weights and accordingly saving in transportations; only equipped, insulating, cast-resistant elements having well trimmed plasters are supplied to the building yard.

The continuous reinforced carrying structure are provided by using semipanels connected by inner castings, thus avoiding the processings for preparing reinforcement irons on the building yard, with full freedom of ensuring supportability and insulation.

The connection of all the outer perimetral carrying walls with the inner partition walls with the slabs is ensured by the continuity of castings which, upon setting, form a monolithic and ascismatic assembly.

The efficient solution to the joint problem is ensured by the inner continuity of castings.

Building yard positioning of window monoblocks, balcony doors and door frames of any type and size at any desired position.

The system assures wide possibilities of changes also at construction step.

Facilitated lay for all technical plants or systems due to the provision of air chambers being left according to design in the composite elements; this also assures an easy and ready maintenance.

What is claimed is:

1. A composite building element of reinforced concrete comprising two parallel coextensive plate-shaped concrete elements having planar uninterrupted inner and outer surfaces with two transverse dimensions, said plate-shaped elements being arranged spaced from each other in a first direction transverse to said dimension; and metal reinforcement means extending between and connecting said plate-shaped elements to each other, said metal reinforcing means including two sheet metal members spaced from one another in said first direction, each of said sheet metal members having a first series of strip-shaped portions spaced from one another in direction of one of said dimensions, each of said strip-shaped portions of said first series extending in directions of both said dimensions and being directly embedded in one of said plate-shaped elements over a plane, each of said sheet metal members further having a second series of strip-shaped portions spaced from the first series of strip-shaped portions in said first direction and offset with respect thereto in the direction of said one dimension, each of the strip-shaped portions of said second series also extending in directions of both said dimensions, and each strip-shaped portion of said second series of one of said sheet metal members being connectible with that of the other of said sheet metal members over a further plane, each of said sheet metal members also having a plurality of sidewall portions respectively integrally connecting opposite edges of the strip-shaped portions of said first series with those of said second series, said strip-shaped portions and said sidewall portions being provided with a plurality of openings.

2. A composite building element as defined in claim 1; and further comprising connecting means for connecting the strip-shaped portions of said second series of one of said metal sheet members with those of the other of said metal sheet members.

3. A composite building element as defined in claim 1, wherein said strip-shaped portions and said side wall portions are formed with tangs projecting in the region of said openings therefrom.

4. A composite building element as defined in claim 1, and including a layer of insulating material embedded in one of said plate-shaped elements coextensive therewith and outwardly of said metal reinforcement means.

5. A composite building element as defined in claim 4, wherein said layer of insulating material is provided on opposite surfaces thereof with transversely spaced dovetailed grooves and said one plate-shaped element is provided with corresponding dovetailed ridges respectively engaged in said grooves.

6. A composite building element as defined in claim 1, and including a mass of concrete about said metal reinforcement means and filling the space between said plate-shaped elements.

* * * * *